US007600612B2

(12) United States Patent
Passeri

(10) Patent No.: US 7,600,612 B2
(45) Date of Patent: Oct. 13, 2009

(54) HYDRAULIC SYSTEM FOR AN INDUSTRIAL VEHICLE

(75) Inventor: Gianni Passeri, Virgilio (IT)

(73) Assignee: NMHG Oregon, LLC, Portland, OR (US)

( * ) Notice: Subject to any disclaimer, the term of this patent is extended or adjusted under 35 U.S.C. 154(b) by 193 days.

(21) Appl. No.: 11/404,173

(22) Filed: Apr. 13, 2006

(65) Prior Publication Data

US 2006/0233633 A1 Oct. 19, 2006

Related U.S. Application Data

(60) Provisional application No. 60/671,547, filed on Apr. 14, 2005.

(51) Int. Cl.
*B66F 9/22* (2006.01)

(52) U.S. Cl. ..... 187/224; 187/275; 60/413

(58) Field of Classification Search ..... 187/224, 187/275; 414/636
See application file for complete search history.

(56) References Cited

U.S. PATENT DOCUMENTS 3,512,072 A * 5/1970 Karazija et al. ..... 320/127
3,947,744 A * 3/1976 Grace et al. ..... 320/128
3,994,133 A * 11/1976 Pfeil et al. ..... 60/422
4,044,786 A * 8/1977 Yip ..... 137/101
4,286,692 A * 9/1981 Bauer et al. ..... 187/224
4,467,894 A * 8/1984 Sinclair ..... 187/224
4,543,031 A * 9/1985 Luebrecht et al. ..... 414/631
4,819,430 A * 4/1989 Becker ..... 60/421
4,823,551 A * 4/1989 Hehl ..... 60/422
4,961,316 A * 10/1990 Corke et al. ..... 60/431
5,179,836 A * 1/1993 Dantlgraber ..... 60/430
5,505,043 A * 4/1996 Baginski et al. ..... 60/477
6,205,781 B1 * 3/2001 A'Hearn ..... 60/421
6,460,332 B1 * 10/2002 Maruta et al. ..... 60/414
7,127,887 B2 * 10/2006 Nakamura et al. ..... 60/421

FOREIGN PATENT DOCUMENTS

JP 2-169499 A * 6/1990 ..... 187/224

* cited by examiner

*Primary Examiner*—James Keenan
(74) *Attorney, Agent, or Firm*—Stolowitz Ford Cowger LLP

(57) ABSTRACT

An industrial vehicle including a lifting device, a hydraulic system having two or more pump motors that provide hydraulic flow to the lifting device, a load-handling device, and a second hydraulic system fluidly coupled to the main hydraulic system. The hydraulic system diverts the hydraulic flow from one of the pump motors to the second hydraulic system when an actuation of the load handling device is detected.

12 Claims, 5 Drawing Sheets

| A | B | C | D | E | F | G | H | I | J | | | K | | L | | M | | N | | O | | P | | |
|---|---|---|---|---|---|---|---|---|---|---|---|---|---|---|---|---|---|---|---|---|---|---|---|---|
| | | | | | | | Pumps | | shuttle | mains | | | hyd.stab. | | forks | | Translate | | Rotate | | Pentograph | | Auxiliary | |
| | | | | | | | F/R | F/R | p2-P | div-p1 | main | div-p2 | open | close | lower | lift | right | left | right | left | open | close | aux1 | aux2 | |
| No. | Function | Cabin | Forks | Translate | Rotate | Pantograph | Auxiliary | Pump 1 | Pump 2 | EV1 | EV2 | EV3 | EV4 | EV5 | EV6 | EV7 | EV8 | EV9 | EV10 | EV11 | EV12 | EV13 | EV14 | EV15 | EV16 | No. |
| 1 | | LIFT | | | | | | FWD | FWD | | | | | | | | | | | | | | | | | 1 |
| 2 | | LOWER | | | | | | REV | REV | | □ | □ | □ | | | | | | | | | | | | | 2 |
| 3 | EMERGENCY | LIFT SLOW | | | | | | FWD | | | | | | | | | | | | | | | | | | 3 |
| 4 | EMERGENCY | LOWER SLOW | | | | | | FWD | | | □ | □ | □ | | | | | | | | | | | | | 4 |
| 5 | | | LIFT | | | | | | FWD | □ | | | | | | | □ | | | | | | | | | 5 |
| 6 | | | LOWER | | | | | | | | | | | | | □ | | | | | | | | | | 6 |
| 7 | COMBINED | LIFT | LIFT | | | | | FWD | FWD | | | | | | | | | | | | | | | | | 7 |
| 8 | COMBINED | LOWER | LOWER | | | | | REV | REV | | □ | □ | □ | | | □ | | | | | | | | | | 8 |
| 9 | COMBINED | LIFT | LOWER | | | | | FWD | FWD | | | | | | | □ | | | | | | | | | | 9 |
| 10 | COMBINED | LOWER | LIFT | | | | | REV | FWD | □ | □ | □ | | | | | | | | | | | | | | 10 |
| 11 | | | | RIGHT | | | | | FWD | □ | | | | | | | | □ | | | | | | | | 11 |
| 12 | EMERGENCY | | | RIGHT | | CLOSE | | | FWD | □ | | | | | | | | □ | | | | | □ | | | 12 |
| 13 | | | | LEFT | | | | | FWD | □ | | | | | | | | | □ | | | | | | | 13 |
| 14 | EMERGENCY | | | LEFT | | CLOSE | | | FWD | □ | | | | | | | | | □ | | | | □ | | | 14 |
| 15 | w/ translate and rotate depeding fork position and condition | | | | | OPEN | | | FWD | □ | | | | | | | | | | | | □ | | | | 15 |
| 16 | w/ translate and rotate depeding fork position and condition | | | | | CLOSE | | | FWD | □ | | | | | | | | | | | | | □ | | | 16 |
| 17 | | | | | RIGHT | | | | FWD | □ | | | | | | | | | | □ | | | | | | 17 |
| 18 | | | | | LEFT | | | | FWD | □ | | | | | | | | | | | □ | | | | | 18 |
| 19 | FORK POSITIONER | | | | | | OPEN | | FWD | □ | | | | | | | | | | | | | | □ | | 19 |
| 20 | FORK POSITIONER | | | | | | CLOSE | | FWD | □ | | | | | | | | | | | | | | | □ | 20 |
| 21 | TILTING FORKS | | | | | | UP +2° | | FWD | □ | | | | | | | | | | | | | | □ | | 21 |
| 22 | TILTING FORKS | | | | | | DOWN -4° | | FWD | □ | | | | | | | | | | | | | | | □ | 22 |
| 23 | SYNCRO FORKS | | | LEFT | RIGHT | | | | FWD | □ | | | | | | | | | □ | □ | | | | | | 23 |
| 24 | SYNCRO FORKS | | | RIGHT | LEFT | | | | FWD | □ | | | | | | | | □ | | | □ | | | | | 24 |
| 25 | CENTER FORKS | | | LEFT | RIGHT | | | | FWD | □ | | | | | | | | | □ | □ | | | | | | 25 |
| 26 | CENTER FORKS | | | RIGHT | LEFT | | | | FWD | □ | | | | | | | | □ | | | □ | | | | | 26 |
| 27 | COMBINED | | LIFT | LEFT | | | | | FWD | □ | | | | | | | □ | | □ | | | | | | | 27 |
| 28 | COMBINED | | LIFT | RIGHT | | | | | FWD | □ | | | | | | | □ | □ | | | | | | | | 28 |
| 29 | COMBINED | | LIFT | | LEFT | | | | FWD | □ | | | | | | | □ | | | | □ | | | | | 29 |
| 30 | COMBINED | | LIFT | | RIGHT | | | | FWD | □ | | | | | | | □ | | | □ | | | | | | 30 |
| 31 | COMBINED | | LIFT | LEFT | LEFT | | | | FWD | □ | | | | | | | □ | | □ | | □ | | | | | 31 |
| 32 | COMBINED | | LIFT | LEFT | RIGHT | | | | FWD | □ | | | | | | | □ | | □ | □ | | | | | | 32 |
| 33 | COMBINED | | LIFT | RIGHT | RIGHT | | | | FWD | □ | | | | | | | □ | □ | | □ | | | | | | 33 |
| 34 | COMBINED | | LIFT | RIGHT | LEFT | | | | FWD | □ | | | | | | | □ | □ | | | □ | | | | | 34 |
| 35 | COMBINED | | LOWER | LEFT | | | | | FWD | □ | | | | | | □ | | | □ | | | | | | | 35 |
| 36 | COMBINED | | LOWER | RIGHT | | | | | FWD | □ | | | | | | □ | | □ | | | | | | | | 36 |
| 37 | COMBINED | | LOWER | LEFT | LEFT | | | | FWD | □ | | | | | | □ | | | □ | | □ | | | | | 37 |
| 38 | COMBINED | | LOWER | LEFT | RIGHT | | | | FWD | □ | | | | | | □ | | | □ | □ | | | | | | 38 |
| 39 | COMBINED | | LOWER | RIGHT | RIGHT | | | | FWD | □ | | | | | | □ | | □ | | □ | | | | | | 39 |
| 40 | COMBINED | | LOWER | RIGHT | LEFT | | | | FWD | □ | | | | | | □ | | □ | | | □ | | | | | 40 |
| 41 | COMBINED | LIFT | | LEFT | | | | FWD | FWD | □ | | | | | | | | | □ | | | | | | | 41 |
| 42 | COMBINED | LIFT | | RIGHT | | | | FWD | FWD | □ | | | | | | | | □ | | | | | | | | 42 |
| 43 | COMBINED | LIFT | | | LEFT | | | FWD | FWD | □ | | | | | | | | | | | □ | | | | | 43 |
| 44 | COMBINED | LIFT | | | RIGHT | | | FWD | FWD | □ | | | | | | | | | | □ | | | | | | 44 |
| 45 | COMBINED | LIFT | | LEFT | LEFT | | | FWD | FWD | □ | | | | | | | | | □ | | □ | | | | | 45 |
| 46 | COMBINED | LIFT | | LEFT | RIGHT | | | FWD | FWD | □ | | | | | | | | | □ | □ | | | | | | 46 |
| 47 | COMBINED | LIFT | | RIGHT | RIGHT | | | FWD | FWD | □ | | | | | | | | □ | | □ | | | | | | 47 |
| 48 | COMBINED | LIFT | | RIGHT | LEFT | | | FWD | FWD | □ | | | | | | | | □ | | | □ | | | | | 48 |
| 49 | COMBINED | LOWER | | LEFT | | | | REV | FWD | □ | □ | □ | | | | | | | □ | | | | | | | 49 |
| 50 | COMBINED | LOWER | | RIGHT | | | | REV | FWD | □ | □ | □ | | | | | | □ | | | | | | | | 50 |
| 51 | COMBINED | LOWER | | LEFT | LEFT | | | REV | FWD | □ | □ | □ | | | | | | | □ | | □ | | | | | 51 |
| 52 | COMBINED | LOWER | | LEFT | RIGHT | | | REV | FWD | □ | □ | □ | | | | | | | □ | □ | | | | | | 52 |
| 53 | COMBINED | LOWER | | RIGHT | RIGHT | | | REV | FWD | □ | □ | □ | | | | | | □ | | □ | | | | | | 53 |
| 54 | COMBINED | LOWER | | RIGHT | LEFT | | | REV | FWD | □ | □ | □ | | | | | | □ | | | □ | | | | | 54 |
| 55 | COMBINED | LIFT | LIFT | LEFT | | | | FWD | FWD | □ | | | | | | | □ | | □ | | | | | | | 55 |
| 56 | COMBINED | LIFT | LIFT | RIGHT | | | | FWD | FWD | □ | | | | | | | □ | □ | | | | | | | | 56 |
| 57 | COMBINED | LIFT | LIFT | | LEFT | | | FWD | FWD | □ | | | | | | | □ | | | | □ | | | | | 57 |
| 58 | COMBINED | LIFT | LIFT | | RIGHT | | | FWD | FWD | □ | | | | | | | □ | | | □ | | | | | | 58 |
| 59 | COMBINED | LIFT | LIFT | LEFT | LEFT | | | FWD | FWD | □ | | | | | | | □ | | □ | | □ | | | | | 59 |
| 60 | COMBINED | LIFT | LIFT | LEFT | RIGHT | | | FWD | FWD | □ | | | | | | | □ | | □ | □ | | | | | | 60 |
| 61 | COMBINED | LIFT | LIFT | RIGHT | RIGHT | | | FWD | FWD | □ | | | | | | | □ | □ | | □ | | | | | | 61 |
| 62 | COMBINED | LIFT | LIFT | RIGHT | LEFT | | | FWD | FWD | □ | | | | | | | □ | □ | | | □ | | | | | 62 |
| 63 | COMBINED | LOWER | LOWER | LEFT | | | | REV | FWD | □ | □ | □ | | | | □ | | | □ | | | | | | | 63 |
| 64 | COMBINED | LOWER | LOWER | RIGHT | | | | REV | FWD | □ | □ | □ | | | | □ | | □ | | | | | | | | 64 |
| 65 | COMBINED | LOWER | LOWER | LEFT | LEFT | | | REV | FWD | □ | □ | □ | | | | □ | | | □ | | □ | | | | | 65 |
| 66 | COMBINED | LOWER | LOWER | LEFT | RIGHT | | | REV | FWD | □ | □ | □ | | | | □ | | | □ | □ | | | | | | 66 |
| 67 | COMBINED | LOWER | LOWER | RIGHT | RIGHT | | | REV | FWD | □ | □ | □ | | | | □ | | □ | | □ | | | | | | 67 |
| 68 | COMBINED | LOWER | LOWER | RIGHT | LEFT | | | REV | FWD | □ | □ | □ | | | | □ | | □ | | | □ | | | | | 68 |
| 69 | OVER-RIDE | LIFT | | | | | | | FWD | | | | | | | | | | | | | | | | | 69 |
| 70 | STABILIZERS DOWN w/ lift depending height condition | | | | | | | | FWD | | | | | □ | | | | | | | | | | | | 70 |
| 71 | STABILIZERS UP w/ lower depending height condition | | | | | | | | | | | | | | □ | | | | | | | | | | | 71 |
| | | | | | | | | Pump 1 | Pump 2 | EV1 | EV2 | EV3 | EV4 | EV5 | EV6 | EV7 | EV8 | EV9 | EV10 | EV11 | EV12 | EV13 | EV14 | EV15 | EV16 | |
| | | | | | | | | F/R | F/R | p2-P | div-p1 | main | div-p2 | open | close | lower | lift | right | left | right | left | open | close | aux1 | aux2 | |
| | | | | | | | | Pumps | | shuttle | mains | | | hyd.stab. | | forks | | Translate | | Rotate | | Pentograph | | Auxiliary | | |

FIG. 8

HYDRAULIC SYSTEM FOR AN INDUSTRIAL VEHICLE

This application claims priority from U.S. Provisional Application 60/671,547, filed Apr. 14, 2005, and herein incorporated by reference.

BACKGROUND OF THE INVENTION

The invention relates to a hydraulic system used in an industrial vehicle, and in particular a materials handling vehicle or forklift truck. Examples of forklift trucks include reach trucks and turret trucks.

Forklift trucks are used in the transportation of goods and materials in a wide variety of applications. A fundamental characteristic of a forklift truck is the ability to lift and lower a load. Similarly, in order to improve efficiencies of transportation, additional load handling functions may be employed to adjust the position of the load after it has been raised. These functions, including lifting and lowering, are typically controlled by hydraulic systems that use hydraulic pressure that provides an operating force. The hydraulic system includes a pump and motor to generate the hydraulic pressure and corresponding hydraulic flow that operates mechanical devices performing the hydraulic functions.

An operator of the forklift truck is typically seated or standing in an operator cabin that includes any number of operator controls. Some of these operator controls control the hydraulic functions, including lifting and lowering the load. Other hydraulic functions may include side-shifting the load or tilting a mast, for example.

Hydraulic systems have a finite level of hydraulic fluid and hydraulic pressure that may be utilized in operating the hydraulic functions. For example, an available hydraulic fluid level may be limited by the size of a hydraulic reservoir. Similarly, the hydraulic pressure may be limited by the size of the hydraulic pump. Performance of the hydraulic functions can be reduced if the operator attempts to operate more than one hydraulic function at the same time, or the hydraulic system may instead restrict operation to one function at any given time. In either case, efficiencies of operation are negatively impacted.

The present invention addresses these and other problems associated with the prior art.

SUMMARY OF THE INVENTION

A hydraulic system may include a main hydraulic system having two or more pump motors and a second hydraulic system fluidly coupled to the main hydraulic system. A load sensing circuit detects a change in hydraulic pressure and diverts a hydraulic flow from one of the two or more pump motors to the second hydraulic system.

The foregoing and other objects, features and advantages of the invention will become more readily apparent from the following detailed description of a preferred embodiment of the invention which proceeds with reference to the accompanying drawings.

BRIEF DESCRIPTION OF THE DRAWINGS

FIG. 8 is a table showing some possible combinations of hydraulic functions that may be applied to the forklift truck of FIG. 1.

DETAILED DESCRIPTION

A description of a novel hydraulic system is herein provided, making reference to the aforementioned drawings and the several embodiments described further below.

Figure 1:
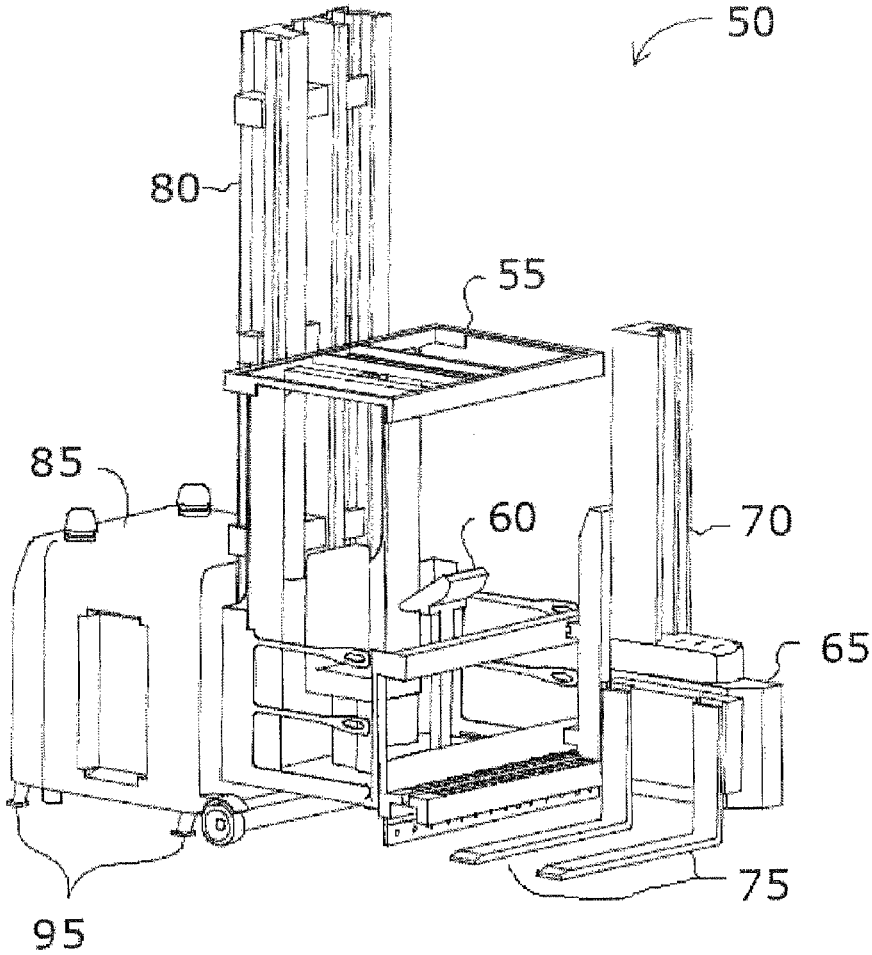
FIG. 1 is a perspective view of an example forklift truck that is suitable for utilizing a hydraulic system herein disclosed.

FIG. 1 provides an example of a typical forklift truck such as a man-up turret truck 50 and is provided as a reference when discussing the various hydraulic schematic drawings shown in FIGS. 2-7. As costs of operation and efficiencies become increasingly important in a global competitive marketplace, more and more demands are placed at the operational level to improve product throughput. In the materials handling industry, one measure of productivity is the number of pallets or loads that may be transported in a given hour, otherwise known as cycle time. Factors that may influence the number of pallets transported per hour include the travel speed of a vehicle, such as the forklift truck 50, the lift and lower rate of a mast, such as a main mast 80, and the ease of use of hydraulic controls, such as operator controls 60.

It is therefore advantageous to increase functionality and performance of the forklift truck 50 by providing operator controls 60 that operate a hydraulic system more efficiently. For example, a hydraulic system may reduce cycle time by combining hydraulic functions or increasing the number of hydraulic functions that can be operated at the same time.

Accordingly, an improved hydraulic system includes a load sensing system that controls pump flow to one or more hydraulic functions in a forklift truck. Certain hydraulic functions that may be actuated concurrently are combined while maintaining desired performance levels of each function. Power regeneration is also provided when the hydraulic system returns to a state of reduced pressure.

Figure 2:
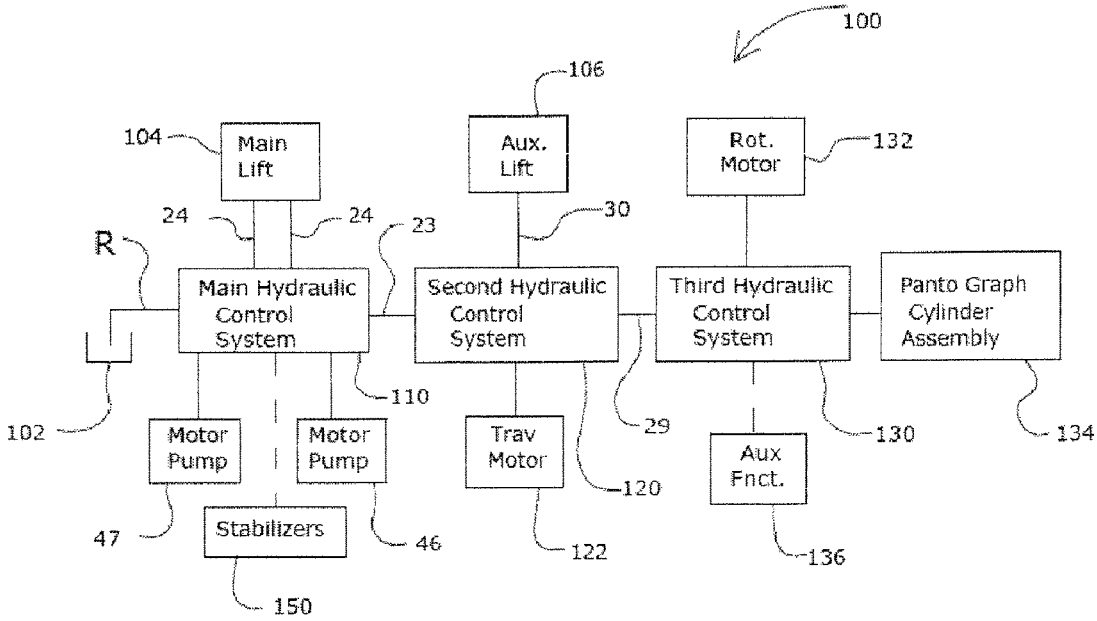
FIG. 2 is a simplified system diagram of the hydraulic system.

This is described in more detail in FIG. 2 that shows a simplified diagram of an improved hydraulic system 100. The hydraulic system 100 may be comprised of the following principle components: two hydraulic pump and motor assemblies 46 and 47, main hydraulic system 110, a second hydraulic system 120, a third hydraulic system 130, and a hydraulic reservoir 102. The acting hydraulic components may include a main lift cylinder assembly 104, traverse motor 122, auxiliary lift cylinder assembly 106, rotation motor and assembly 132, and a pantograph cylinder assembly 134.

By way of example, some of the possible hydraulic functions that are compatible with the hydraulic system 100 of FIG. 2 are now described, by making reference to the components shown in FIG. 1. The main lift cylinder assembly 104 may be operated to lift and lower an operator cabin 55. The traverse motor 122 may be used to translate, or side-shift, an attachment 65 to the left and to the right. An auxiliary lift cylinder 106 may be used to lift and lower the attachment 65 or forks 75, which may in turn be mounted to an auxiliary mast 70. The rotation motor assembly 132 may be used to rotate the forks 75 about a vertical axis of rotation to the left and right side of the forklift truck 50. A pantograph cylinder assembly 134 may be used to extend and retract the forks 75. Stabilizers 95 may also be included on the bottom of the forklift truck 50 on both the left and right sides to provide additional vehicle stability, for example, in a lateral direction. Other or optional hydraulic attachments may include a fork positioner, tilting forks, or a fork sideshifter, for example.

It is noted that the simplified system diagram shown in FIG. 2 shows two hydraulic lines 24 going to the main lift cylinder assembly 104, whereas there is only one hydraulic line 30 leading to the auxiliary lift cylinder assembly 106. This representation is intended to demonstrate that there are typically two lift cylinders used in the main lift cylinder assembly 104. Whereas there is typically only a single lift cylinder in the auxiliary lift cylinder assembly 106 used for lifting and lowering the attachment 65 or forks 75 attached to the auxiliary mast 70.

A different number of cylinders may be used in the main and auxiliary lift cylinder assemblies 104 and 106 due to a difference in weight between the operator cabin 55 and the attachment 65. Two cylinders may be required to lift a heavier operator cabin 55. However it is understood that fewer or less cylinders may be used for either the main or auxiliary lift cylinder assemblies 104 and 106, respectively, depending on the size of the lift cylinders and the weight of the component or load being lifted.

Hydraulic control systems 110, 120 and 130 may be fluidly connected by one or more hydraulic lines having hydraulic ports 23 and 29, however it is understood that more or fewer hydraulic lines may be used, and that FIG. 2 is a simplified system diagram. Similarly, one or more one tank return lines, such as return line R, can be used to connect the main hydraulic system 110 to the hydraulic reservoir 102. Similarly, separate hydraulic lines can connect the hydraulic reservoir 102 to other hydraulic control systems 120 and 130.

The main hydraulic control system 110 may be located in a motor compartment 85 of the forklift truck 50, as shown in FIG. 1, along with the hydraulic pump and motor assemblies 46 and 47 and the hydraulic reservoir 102, for example. The second hydraulic control system 120 may be mounted on top of the attachment 65. The third hydraulic control system 130 may be mounted on a front face of the attachment 65. Of course this is just one example of where the different hydraulic assemblies may be located.

Figure 3:
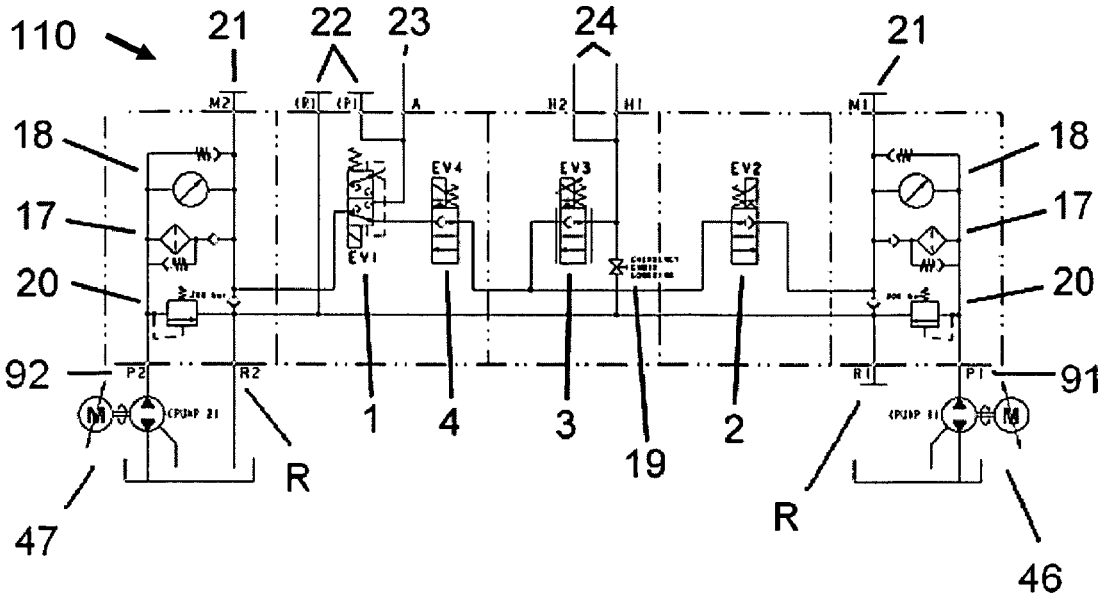
FIG. 3 is a schematic diagram of a main hydraulic control system.

FIG. 3 is a schematic representation of the main hydraulic control system 110 for the overall hydraulic system 100. The main hydraulic control system 110 divides flow between the main lift cylinder assembly 104 and the rest of the hydraulic assembly 100. The main hydraulic control system 110 may include an variable positioning flow control valve 3, two on-off flow control valves 2 and 4, a two-position selector valve 1, a filter with bypass 17 and an optical clog indicator 18 for each hydraulic supply line, and an emergency manual lowering valve 19 for the main lift cylinder assembly 104.

In addition, the main hydraulic control system 110 may include a maximum pressure relief valve 20 and a monometer port 21 for each hydraulic supply line, a pressure and tank port 22 for optional stabilizers 95, a pressure port 23 to supply hydraulic fluid to the second hydraulic control system 120, dual pressure ports 24 fluidly coupled to the main lift cylinder assembly 104, and pressure and tank ports 91 and 92 for the hydraulic pump and motor assemblies 46 and 47.

Figure 4:
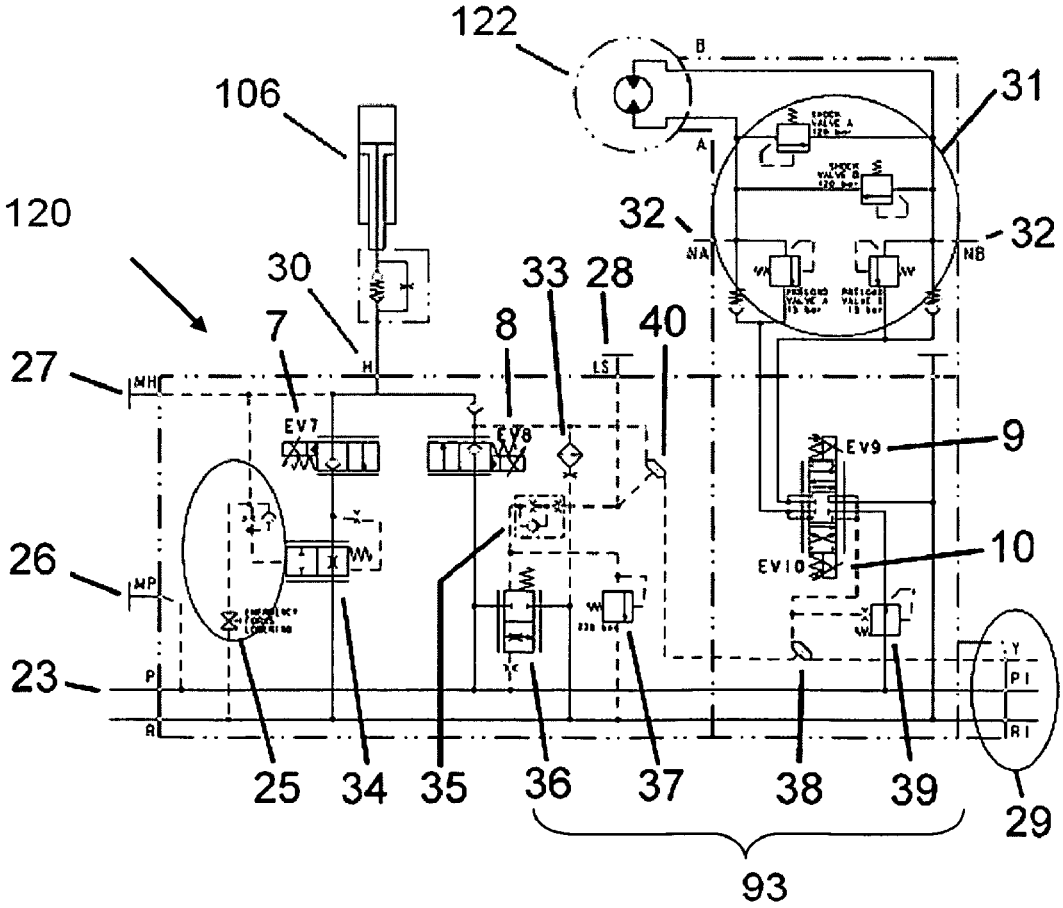
FIG. 4 is a schematic diagram of a second hydraulic control system.

FIG. 4 is a schematic diagram for the second hydraulic control system 120. The second hydraulic control system 120 controls flow to the traverse motor 122, auxiliary lift cylinder assembly 106, and the third hydraulic control system 130. The second control system 120 may include two variable positioning flow control valves 7 and 8, two variable positioning directional valves 9 and 10, an emergency manual lowering valve 25, a manometer port 26 for a pressure supply line, and a manometer port 27 for a pressure return line.

In addition, the second hydraulic control system 120 may include a load sensing manometer port 28, load sensing, pressure and return ports 29 to the third hydraulic control system 130, a pressure port 30 to the auxiliary lift cylinder assembly 106, and pressure ports 31 for the traverse motor 122 with preload and shock valves. Additionally, the second hydraulic control system 120 may include tapped ports 32 to manually release pressure from the traverse motor 122, a gigler valve 33, a flow compensation valve 34 for lowering the forks 75 and a pressure limiting valve 39 for the traverse motor 122.

The second hydraulic control system 120 may include additional load sensing components such as a flow compensation valve 36, a stabilizer valve 35, two flip flop valves 38 and 40, and a maximum pressure relief valve 37. The load sensing components may be collectively referred to as a load sensing circuit 93, although load sensing components may be concentrated or distributed between one or more of the hydraulic control systems 110-130 and the hydraulic and auxiliary functions.

Figure 5:
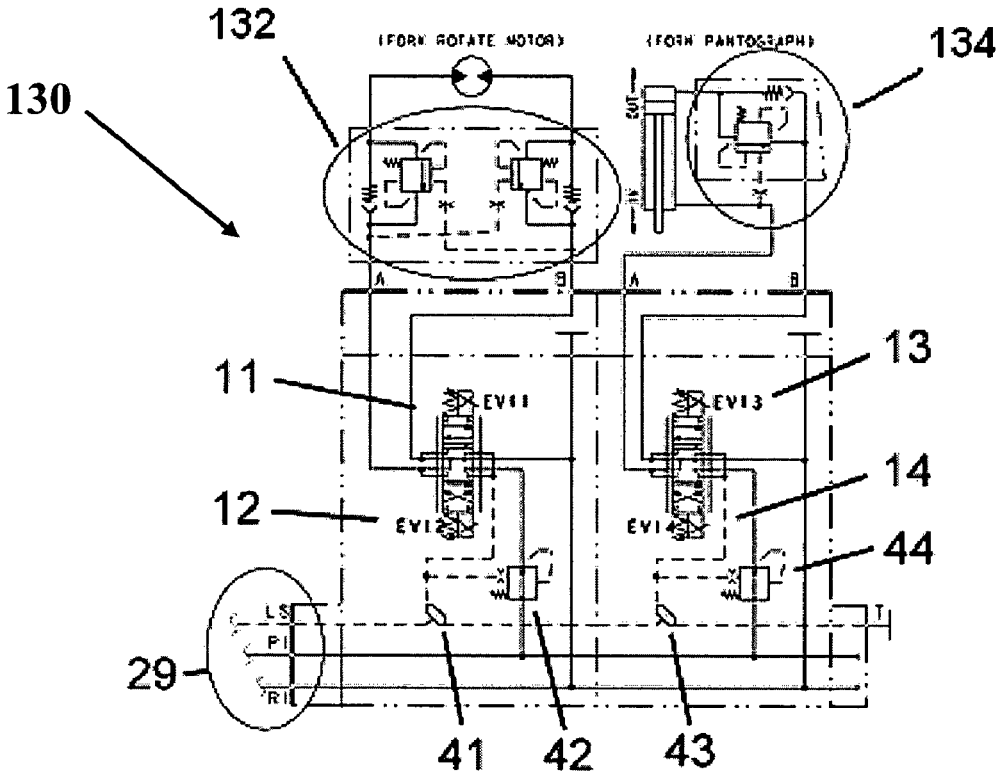
FIG. 5 is a schematic diagram of a third hydraulic control system.

FIG. 5 is a schematic diagram for the third hydraulic control system 130. The third hydraulic control system 130 may control hydraulic functions such as rotation, pantograph and one or more additional auxiliary hydraulic functions. The third hydraulic control system 130 may be equipped with two pairs of variable positioning directional valves such as valve pair 11 and 12, and valve pair 13 and 14.

Figure 6:
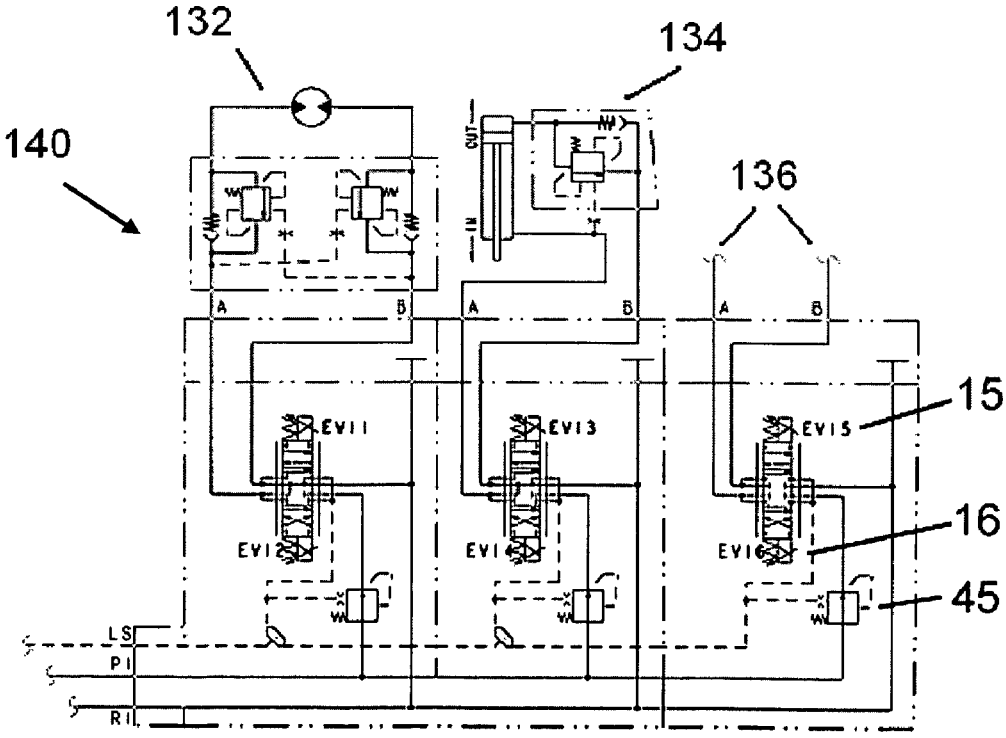
FIG. 6 is a schematic diagram of the third hydraulic control system including an auxiliary hydraulic function.

When utilized for an additional auxiliary function 136, as shown in FIG. 6, a third pair of variable positioning directional valves 15 and 16 may be added to an alternate embodiment of a third hydraulic control system 140. Additionally, the third hydraulic control systems 130 and 140 may include pressure limiting valves such as valves 42, 44 and 45 to control various auxiliary hydraulic functions, and flip-flop shuttle valves such as valves 41 and 43 to control hydraulic rotate and pantograph functions. In one embodiment, the auxiliary functions are not included as part of the load sensing circuit 93.

Figure 7:
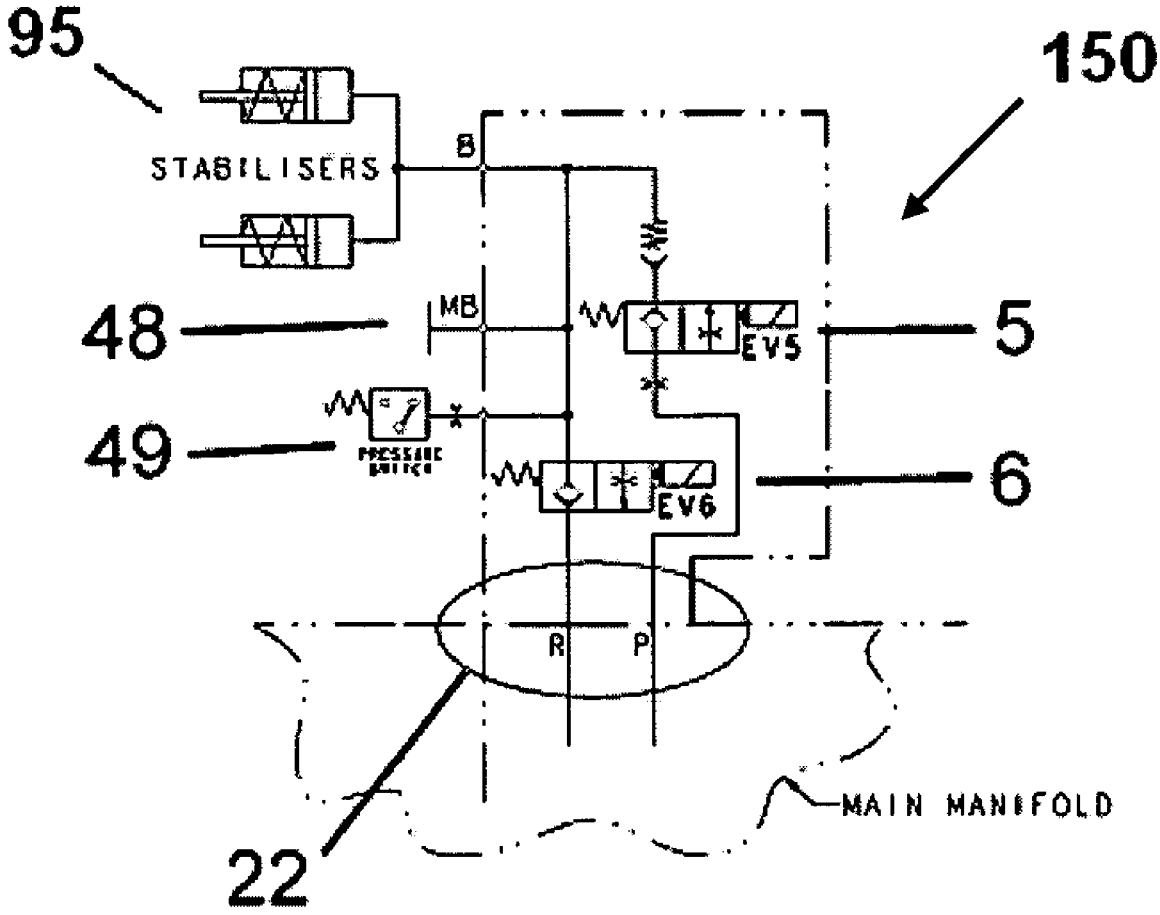
FIG. 7 is a schematic diagram of a hydraulic stabilizer.

FIG. 7 is a schematic diagram for the hydraulic stabilizer system 150, which may be rigidly mounted and fluidly coupled to the main hydraulic control system 110, or which may be connected by ports and hoses or tubes, for example. The hydraulic stabilizer system 150 may be configured as an optional function. The hydraulic stabilizer system 150 may include a directional and check valve assembly 5 that pressurizes the hydraulic system 100 and causes the hydraulic stabilizers 95 to be lowered. When included on the forklift truck 50, the hydraulic stabilizers 95 may be attached to a vehicle frame and come into contact with the ground when lowered. In this manner, the forklift truck 50 is provided additional lateral stability when a load and the forks 75 are rotated, for example, with the main mast 80 in an elevated position. Similarly, the hydraulic stabilizer system 150 may include a directional valve 6 to release a pressure of the hydraulic system 100 and permit the hydraulic stabilizers 95 to rise. Furthermore, the hydraulic stabilizer system 150 may include a manometer port 48 and a pressure switch 49.

The hydraulic system 100 (FIG. 2) provides a number of advantages over conventional hydraulic systems. For example, depending on the hydraulic flow and pressure requirements, the main hydraulic control system 110 can combine or divide the flow of two or more pumps and motors, such as hydraulic pump and motor assemblies 46 and 47.

If only the main lift cylinder assembly 104 is activated, then a combined hydraulic flow and pressure from both hydraulic pump and motor assemblies 46 and 47 may be utilized to lift the operator cabin 55. When a second hydraulic function is activated, then the main hydraulic control system 110 may divide the flow from the hydraulic pump and motor assemblies 46 and 47 between operating the main lift cylinder assembly 104 and the other hydraulic function. In this manner, a first pump and motor, such as hydraulic pump and motor assembly 46, may be utilized to lift the operator cabin 55. The second pump and motor, such as hydraulic pump and motor assembly 47, may be used to actuate the auxiliary hydraulic function.

The hydraulic system permits combined movements of the operator cabin 55 and the attachment 65 or forks 75 in a number of ways. The table shown in FIG. 8 provides a list of 71 different combinations of functions that may be performed, although it is understood that more combinations are possible in a manner similarly described and as enabled by the various hydraulic schematic circuit diagrams. FIG. 8 provides a partial list of preferred combinations of hydraulic functions which, according to one embodiment, are utilized in a turret truck such as the forklift truck 50 shown in FIG. 1. The table in FIG. 8 includes columns identified by letters A-P, and rows 1-71. The rows 1-71 indicate each of the different combinations of the 71 functions previously discussed. Columns A-P identify functions and their respective components that are enabled to perform the function.

An enabled, or open, valve in columns I-P is indicated by a box located in a respective selection square, whereas a disabled, or closed, valve is indicated by an empty selection square. For example, the selection square in column I for row 5 indicates an open valve 1, whereas the selection square in column I for row 6 indicates a closed valve 1. Similarly, the second pump "pump 2" in the pump columns identified as H is shown as being enabled in a "FWD" forward direction for row 1, and as being enabled in a "REV" reverse direction for row 2, thereby providing an example of the two bidirectional flow states that may be used. In row 3, the empty square indicates that the second pump "pump 2" is disabled. In one embodiment, "pump 1" is understood as being included in the hydraulic pump and motor assembly 46, whereas "pump 2" is understood as being included in the hydraulic pump and motor assembly 47.

Column A identifies a name of a system function to be performed, for example rows 23 and 24 indicate a fork synchronization system function. Columns B-G indicate the hydraulic functions or types of components or attachments that are involved with the system function. For example, fork synchronization system functions identified at rows 23 and 24 include hydraulic functions of Translate, identified at column D, and Rotate, identified at column E, wherein both Translate and Rotate may be in either a "LEFT" or "RIGHT" orientation.

Columns H-P indicate the pumps or valves that are utilized to perform the hydraulic functions. For example, the fork synchronization system functions at rows 23 and 24 include actuation of a second pump, "pump 2" at column I, such as used in the pump and motor assembly 47. System functions at rows 23 and 24 further include actuation of the Translate valves 9 and 10, reference column M, and the Rotate valves 11 and 12, reference column N. Valves 9-12 are also shown with respect to the hydraulic schematic diagrams of FIGS. 4 and 5.

In general, independent movement of the operator cabin 55 through actuation of the main hoist cylinder assembly 104 may be combined with any front end attachment functions, such as lifting and lowering, translation, and rotation of the forks 75. When no front end attachment function is selected, for example in rows 1-4, then all hydraulic flow from the first and second pumps in hydraulic pump and motor assemblies 46 and 47, may be directed to the main hoist cylinder assembly 104, with selector valve 1, identified in the table as EV1 in column I, in a closed position.

As soon as a front end attachment function is selected, for example at rows 5 and 10-68, then selector valve 1 is shifted to an open position which reroutes a pressure from the hydraulic pump and motor assembly 47 to port 23, shown in FIG. 3. The hydraulic pump and motor assembly 46 continues to send pressure to the main hoist cylinder assembly 104. Hydraulic pump speeds may be adjusted to control the sending pressure and lifting rates of the main hoist cylinder assembly 104. In this manner, desired operating pressures and speeds may be maintained even when combined hydraulic pressures are requested.

In the system function identified at row 9 in FIG. 8, independent movement of the main hoist cylinder assembly 104 to lift the operator cabin 55, identified at column B, is combined with a lowering of the forks 75, identified at column C. In this case, instead of opening selector valve 1, the variable positioning flow control valve 7, identified as "EV7" in the Forks column L, is opened to adjust the lowering rate of the forks 75.

Similarly, in the system function identified at row 10, independent movement of the main hoist cylinder assembly 104 to lower the operator cabin 55, identified at column B, is combined with a lifting of the forks 75, identified at column C. In this case, on-off flow control valve 2, identified as "EV 2" in the Mains column J, and the infinitely positioning flow control valve 3, identified as "EV 3", are opened to permit a lowering of the operator cabin 55, shown in FIG. 1. "Pump 1" in the Pumps columns H is operated in a reverse direction so that the hydraulic pump and motor assembly 46 directs a hydraulic return to the hydraulic reservoir 102. The infinitely positioning flow control valve 8, identified as "EV 8" in the Forks column L, is opened to permit the hydraulic pump and motor assembly 47 to lift the forks 75.

In addition, in the system function identified at row 8, independent movement of the main hoist cylinder assembly 104 to lower the operator cabin 55, identified at column B, is combined with a lowering of the forks 75, identified at column C. In this case, valves 2, 3, 4 and 7 are opened, and "Pump 1" and "Pump 2" of the hydraulic pump and motor assemblies 46 and 47 are operated in a reverse direction to permit a hydraulic return to the hydraulic reservoir 102. The variable positioning flow control valve 3, identified as "EV3" in FIG. 8 controls the lowering speed of the operator cabin 55.

In one embodiment, the load sensing circuit 93 shown generally in FIG. 4, provides for load sensing between the second and third hydraulic control systems 120 and 130. The load sensing circuit 93 (FIG. 4) permits combined hydraulic functions of an attachment, such as a trilateral or traverse attachment, with controlled hydraulic flow and pressure. In this manner, synchronized hydraulic functions such as translation, rotation, and centering of the fork position may be achieved by using hydraulic feedback response. The load sensing circuit 93 permits combined movements between the second and third hydraulic control systems 120 and 130 by stabilizing up to four or more different operating pressures and flow rates, while utilizing the same hydraulic source.

The load sensing circuit 93 starts with the flow compensation valve 36 positioned on the pressure line to the auxiliary lift cylinder assembly 106 and before the flow control valve 8, as shown in FIG. 4. The flow control valve 8 is piloted by a working pressure of the various hydraulic functions on the load sensing circuit 93, such as forks lifting, translation, rotation, and pantograph.

The flip-flop type shuttle valves 38, 40 (FIG. 4) and 41, 43 (FIG. 5) may be located in the load sensing circuit 93 between each hydraulic function, such that a highest working pressure pilots the flow compensation valve 36. The stabilizer valve 35 may be located before the flow compensation valve 36 on the load sensing circuit 93 in order to remove any pressure spikes in the hydraulic system 100. Therefore, it can be understood that sending pressure and hydraulic flow at port 23 may be limited by the flow compensation valve 36, which may be driven by the pilot pressure in the load sensing circuit 93. In this way, the optimum hydraulic pressure and flow requirements may be maintained.

The load sensing circuit 93 may be limited to a maximum operating pressure by the pressure relief valve 37 and, for example, may become active according to a minimum threshold pressure operating on a valve preload of the flow compensation valve 36. When a low hydraulic pressure is applied, the pressure relief valve 37 tends toward being open, whereas when an increasing hydraulic pressure is applied, the pressure relief valve 37 tends toward being closed in order to keep a maximum oil flow and pressure in the load sensing circuit 93. In addition, each hydraulic circuit for a given hydraulic function may include a pressure limiting valve, for example pressure limiting valves 20, 39, 42, 44 and 45. The pressure limiting valves limit the required working pressure per a given hydraulic function even if a higher pressure is called by another hydraulic function.

As mentioned, the pumps in the hydraulic pump and motor assemblies 46 and 47 may be bi-directional, and used along with an electrical circuit in the forklift truck 50 to reclaim energy from a return or sending hydraulic pressure of the operator cabin 55 when it is being lowered. Making use of the reclaimed energy may serve to reduce overall battery consumption and prolong a battery charge. Similarly, reducing the number of times a vehicle battery is charged may permit greater operating efficiencies, resulting in a reduced cycle time at no additional cost in overall energy consumption.

By utilizing bi-directional pumps in the hydraulic pump and motor assemblies 46 and 47, the hydraulic system 100 allows a return pressure from a lowering of the operator cabin 55, for example, to turn the bi-directional pumps and hence reclaim energy at the motors. The combination of movements allows for a recovery of energy whether using one or both of the hydraulic pump and motor assemblies 46 and 47, depending if combined hydraulic functions are requested. In this way, a performance of the forklift truck 50 may be improved either by using the recuperated energy to augment active hydraulic function performance levels or by sustaining moderate performance levels over a longer period of time in between battery charging operations.

Having described and illustrated the principles of the invention in a preferred embodiment thereof, it should be apparent that the invention may be modified in arrangement and detail without departing from such principles. I claim all modifications and variation coming within the spirit and scope of the following claims.

The invention claimed is:

1. An industrial vehicle comprising:

a lifting device;

a main hydraulic system to control an operation of the lifting device;

a first pump motor configured to provide hydraulic flow to the lifting device, wherein the first pump motor provides exclusive hydraulic fluid to the lifting device;

a plurality of hydraulic devices other than the lifting device;

a second hydraulic system to control an operation of the plurality of hydraulic devices, wherein the second hydraulic system is fluidly coupled to the main hydraulic system;

a second pump motor configured to provide hydraulic flow to the second hydraulic system when one or more of the plurality of hydraulic devices are actuated, wherein the second pump motor provides exclusive hydraulic fluid to the plurality of hydraulic devices, and wherein the lifting device is simultaneously raised or lowered while the plurality of hydraulic devices are actuated; and a third hydraulic system that is fluidly coupled to the second hydraulic system, wherein a load sensing circuit controls hydraulic flow provided from the second pump motor between the second and third hydraulic systems when the plurality of hydraulic devices are actuated, and wherein when none of the plurality of hydraulic devices are actuated all the combined hydraulic flow from both the first and second pump motors is provided exclusively to the lifting device.

2. The industrial vehicle of claim 1 wherein the pump motors are bi-directional and are configured to reclaim a return hydraulic flow from the main hydraulic system as energy in an electrical circuit of the industrial vehicle when the lifting device is lowered.

3. The industrial vehicle of claims 1 wherein a hydraulic pump speed of the second pump motor is adjusted according to an amount of hydraulic pressure requested by the plurality of hydraulic devices.

4. The industrial vehicle of claim 1 wherein the second hydraulic control system is located on the industrial vehicle in a location that is remote from the main hydraulic system.

5. A hydraulic system for an industrial motorized vehicle, the hydraulic system comprising:

a main hydraulic system having two or more pump and motor assemblies;

a primary hydraulic device controlled by the main hydraulic system, wherein the primary hydraulic device is configured to perform a lift operation;

a second hydraulic system fluidly coupled to the main hydraulic system;

a plurality of auxiliary hydraulic devices controlled by the second hydraulic system;

a first pump and motor assembly configured to provide hydraulic fluid exclusively to the primary hydraulic device;

a second pump and motor assembly configured to provide hydraulic fluid to the main hydraulic system when the lift operation is performing, wherein the second pump and motor assembly is further configured to provide hydraulic fluid to the second hydraulic system when one or more of the auxiliary hydraulic devices are actuated; and a load sensing circuit that is configured to detect a change in pressure in the hydraulic system and to divert a hydraulic flow from the second pump and motor assembly to the second hydraulic system to actuate one or more of the auxiliary hydraulic devices, wherein the hydraulic flow from the second pump and motor assembly is adjusted according to an amount of hydraulic pressure requested by the one or more auxiliary hydraulic devices.

6. The hydraulic system of claim 5 wherein all of a combined hydraulic flow from the first and second pump and motor assemblies is directed to the primary hydraulic device when none of the auxiliary hydraulic devices are actuated.

7. The hydraulic system of claim 5 wherein the primary hydraulic device is configured to lift or lower an operator cabin, and wherein actuation of the one or more auxiliary hydraulic devices causes a change in pressure in the hydraulic system that diverts all of the hydraulic flow from the second pump and motor assembly in the main hydraulic system to the second hydraulic system.

8. The hydraulic system of claim 7 including a third hydraulic system that is fluidly coupled to the second hydraulic system, wherein the load sensing circuit controls hydraulic flow provided from the second pump and motor assembly between the second and third hydraulic systems when the plurality of auxiliary hydraulic devices are actuated.

9. The hydraulic system of claim 8 wherein the hydraulic system is further configured to provide for simultaneous operation of the plurality of auxiliary hydraulic devices and the primary hydraulic device.

10. The hydraulic system of claim 7 wherein when the primary hydraulic device is not performing the lifting operation, and wherein when one or more of the auxiliary hydraulic devices are actuated, a hydraulic flow from the first pump and motor assembly is set to zero.

11. The hydraulic system of claim 5 including flip-flop valves placed between each of the plurality of auxiliary hydraulic devices to identify a highest working pressure of the hydraulic system.

12. The hydraulic system of claim 5 including a pressure relief valve that limits the load sensing circuit to a maximum operating pressure, and wherein the load sensing circuit becomes active according to a minimum threshold pressure operating on a flow compensation valve of the second hydraulic system.

* * * * *

UNITED STATES PATENT AND TRADEMARK OFFICE

CERTIFICATE OF CORRECTION

PATENT NO. : 7,600,612 B2
APPLICATION NO. : 11/404173
DATED : October 13, 2009
INVENTOR(S) : Gianni Passeri It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 376 days.

Signed and Sealed this

Fifth Day of October, 2010

David J. Kappos

David J. Kappos
*Director of the United States Patent and Trademark Office*